US009995118B2

(12) United States Patent
Tanner et al.

(10) Patent No.: US 9,995,118 B2
(45) Date of Patent: Jun. 12, 2018

(54) BELOW MOTOR EQUALIZER OF ELECTRICAL SUBMERSIBLE PUMP AND METHOD FOR CONNECTING

(71) Applicant: Baker Hughes Incorporated, Houston, TX (US)

(72) Inventors: David Tanner, Broken Arrow, OK (US); Aron M. Meyer, Pryor, OK (US); Arturo Luis Poretti, Claremore, OK (US); Ryan P. Semple, Owasso, OK (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 406 days.

(21) Appl. No.: 14/690,041

(22) Filed: Apr. 17, 2015

(65) Prior Publication Data

US 2016/0017701 A1 Jan. 21, 2016

Related U.S. Application Data

(60) Provisional application No. 62/025,316, filed on Jul. 16, 2014.

(51) Int. Cl.
*E21B 43/12* (2006.01)
*F04D 29/06* (2006.01)
(Continued)

(52) U.S. Cl.
CPC ..... *E21B 43/128* (2013.01); *E21B 4/003* (2013.01); *F04D 13/062* (2013.01); *F04D 13/10* (2013.01); *F04D 29/061* (2013.01)

(58) Field of Classification Search
CPC .. F04D 13/0613; F04D 13/0653; F04D 13/08; F04D 13/086; F04D 13/10;
(Continued)

(56) References Cited

U.S. PATENT DOCUMENTS 4,583,923 A 4/1986 James
6,242,829 B1 * 6/2001 Scarsdale ..... E21B 4/003 310/87
(Continued)

OTHER PUBLICATIONS

U.S. Appl. No. 14/683,557, filed Apr. 10, 2015, entitled: "Below Motor Equalizer of Electrical Submersible Pump and Method for Filling".

*Primary Examiner* — Bryan Lettman
*Assistant Examiner* — Charles W Nichols
(74) *Attorney, Agent, or Firm* — Bracewell LLP; James E. Bradley

(57) ABSTRACT

Upper and lower pressure equalizers couple to a lower end of a motor of an electrical submersible pump assembly. An intermediate connection having a liquid flow passage connects the pressure equalizers. A connection valve located in the liquid flow passage closes the liquid flow passage prior to connecting the pressure equalizers with each other, and opens the liquid flow passage after the connection between the pressure equalizers is made. A sensor lower equalizer wire extends from a sensor unit through the lower pressure equalizer to a lower electrical terminal at the upper end of the lower pressure equalizer. A sensor upper equalizer wire connects to the lower electrical terminal and extends through the upper pressure equalizer to an upper electrical terminal at the upper end of the upper pressure equalizer. A sensor motor wire extends downward from the motor into engagement with the upper electrical terminal.

10 Claims, 6 Drawing Sheets

(51) Int. Cl.
*F04D 13/06* (2006.01)
*F04D 13/10* (2006.01)
*E21B 4/00* (2006.01)

(58) Field of Classification Search
CPC .... F04D 13/16; F04D 25/0686; F04D 29/061; F04D 13/062; E21B 4/003; E21B 43/128; E21B 34/12; E21B 34/14
USPC ..... 310/87
See application file for complete search history.

(56) References Cited

U.S. PATENT DOCUMENTS

| | | | | |
|---|---|---|---|---|
| 7,520,735 | B2 | 4/2009 | Merrill et al. | |
| 7,708,534 | B2 | 5/2010 | Parmeter et al. | |
| 8,221,092 | B2 | 7/2012 | Chilcoat et al. | |
| 8,419,390 | B2 | 4/2013 | Merrill et al. | |
| 8,651,837 | B2 | 2/2014 | Tetzlaff | |
| 8,932,034 | B2 | 1/2015 | McKinney et al. | |
| 2004/0136849 | A1* | 7/2004 | Du | E21B 43/128 417/423.11 |
| 2009/0301723 | A1* | 12/2009 | Gray | E21B 23/00 166/301 |
| 2011/0274565 | A1* | 11/2011 | Tetzlaff | F04B 47/06 417/321 |
| 2012/0282792 | A1* | 11/2012 | Schlogl | H01R 13/005 439/196 |
| 2012/0318519 | A1* | 12/2012 | Webb | E21B 33/064 166/358 |

* cited by examiner

BELOW MOTOR EQUALIZER OF ELECTRICAL SUBMERSIBLE PUMP AND METHOD FOR CONNECTING

CROSS REFERENCE TO RELATED APPLICATION

This application claims priority to provisional application Ser. No. 62/025,316, filed Jul. 16, 2014.

FIELD OF THE DISCLOSURE

This disclosure relates in general to electrical submersible well pumps and in particular to a below motor pressure equalizer assembly for reducing a pressure difference between lubricant in the motor and hydrostatic well fluid pressure, and for allowing the expansion and contraction of the lubricant to the motor.

BACKGROUND

Many hydrocarbon wells are produced by electrical submersible well pump assemblies (ESP). A typical ESP includes a centrifugal pomp having a large number of stages, each stage having an impeller and a diffuser. An electrical motor couples to the pump for rotating the impellers. A pressure equalizer or seal section connects to the motor to reduce a pressure differential between lubricant in the motor and the hydrostatic pressure of the well fluid. The pressure equalizer has a motor lubricant passage leading from a flexible barrier such as a bag or bellows into the Interior of the motor. The motor lubricant passage is always open to communicate well fluid pressure applied in the pressure equalizer to the flexible barrier to the motor lubricant in the motor.

With most prior art ESP's, the pressure equalizer or seal section is located between the motor and the pump. In others, the pressure equalizer is mounted below the motor. The pressure equalizer may comprise an upper and lower pressure equalizer in tandem. An intermediate connection between the upper and lower pressure equalizers has an intermediate motor lubricant passage for communicating motor lubricant between the flexible elements in each.

SUMMARY

An electrical submersible pump assembly has a pump, a motor having a rotatable shaft extending along a longitudinal axis and operatively coupled to the pump for driving the pump. An upper pressure equalizer is coupled to a lower end of the motor. A lower pressure equalizer connects to the upper pressure equalizer. Each of the pressure equalizers has a movable equalizing element that communicates well fluid pressure exterior of the pressure equalizers to motor lubricant in the motor. A connection between an upper end of the lower pressure equalizer and a lower end of the upper equalizer has a liquid flow passage through which a liquid in the upper pressure equalizer communicates with a liquid in the lower pressure equalizer. At least one connection valve is located in the liquid flow passage and closes the liquid flow passage prior to connecting the pressure equalizers with each other. The connection valve opens the liquid flow passage after the connection between the lower pressure equalizer and the upper pressure equalizer is made.

Preferably the connection valve is spring-biased to a closed position and opens in response to abutment of the lower end of the upper pressure equalizer with the upper end of the lower pressure equalizer.

A motor equalizer adapter connects between an upper end of the upper pressure equalizer and a lower end of the motor. A motor equalizer passage in the motor equalizer adapter provides for the passage of motor lubricant between the motor and the upper pressure equalizer. A motor equalizer valve in the motor equalizer passage is movable between an open position and a closed position. In the preferred embodiment, an end portion of the shaft is in engagement with the motor equalizer valve while the motor equalizer valve is in a closed position. The motor equalizer valve moves to the open position in response to rotation of the shaft.

In the embodiment shown, the connection valve comprises an upper pressure equalizer lower valve and a lower pressure equalizer upper valve.

Preferably, the movable equalizing element within each of the upper and lower pressure equalizers comprises a bellows. Motor lubricant in fluid communication with the motor lubricant in the motor is located within an interior of the bellows of the upper pressure equalizer. A secondary liquid is located on an exterior of the bellows of the upper pressure equalizer and an interior of the bellows of the lower pressure equalizer. The bellows of the lower pressure equalizer is immersed in well fluid during operation.

The connection between the pressure equalizers includes an upper pressure equalizer lower adapter secured to a lower end of the upper pressure equalizer and a lower pressure equalizer upper adapter secured to an upper end of the lower pressure equalizer. The liquid flow passage extends through the upper pressure equalizer lower adapter and through the lower pressure equalizer upper adapter. The connection valve comprises an upper pressure equalizer lower valve and a lower pressure equalizer upper valve. The upper pressure equalizer lower valve is mounted in the liquid flow passage in the upper pressure equalizer lower adapter and spring biased downward to a closed position protruding from a lower end of the upper pressure equalizer lower adapter. The lower pressure equalizer upper valve is mounted in the liquid flow passage in the lower pressure equalizer upper adapter and spring biased upward to a closed position protruding from an upper end of the lower pressure equalizer upper adapter. Preferably, the upper pressure equalizer lower valve and the lower pressure equalizer upper valve are radially offset from each other relative to the axis such that they do not contact each other when the lower pressure equalizer upper adapter is secured to the upper pressure equalizer lower adapter.

In the embodiment shown, a sensor unit is mounted to a lower end of the low pressure equalizer. A sensor lower equalizer line extends from the sensor unit through the lower pressure equalizer to a lower terminal at the upper end of the lower pressure equalizer. A sensor upper equalizer line is releasably connected to the lower terminal and extends through the upper pressure equalizer to an upper terminal at an upper end of the upper pressure equalizer. A sensor motor line extends downward from the motor and in releasable engagement with the upper terminal.

In the embodiment shown, the liquid flow passage in the connection includes a first portion located on the axis and a second portion radially offset from the axis. The connection valve comprises a first valve mounted on the axis and a second valve radially offset from the first valve. A portion of the sensor motor line extends sealingly through the first valve.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
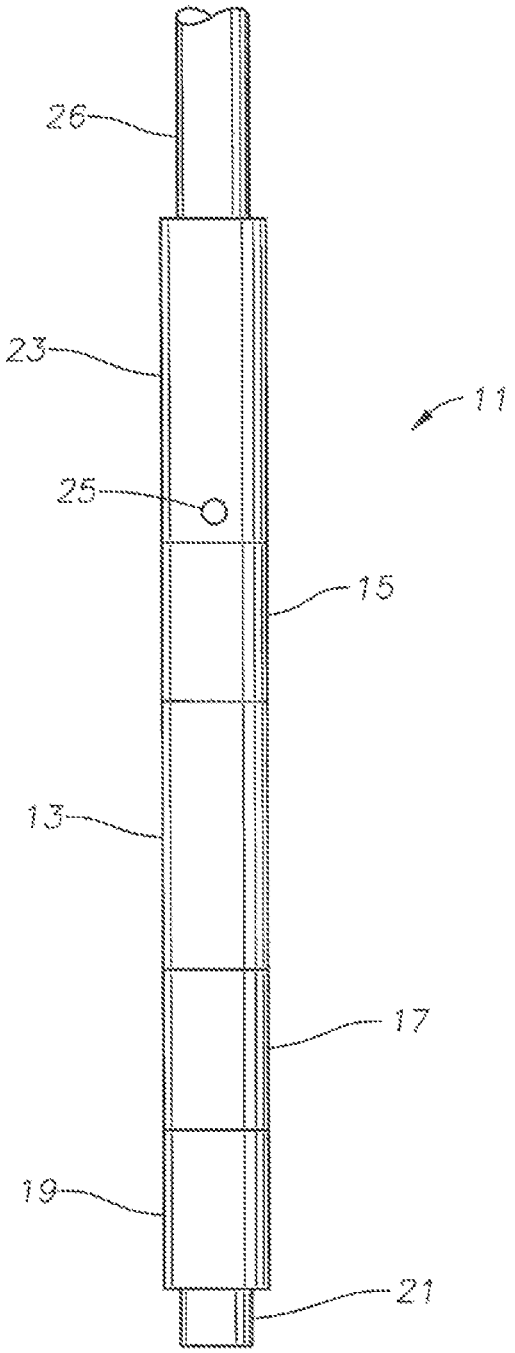
FIG. 1 is a side view of an electrical submersible pump assembly having below motor upper and lower pressure equalizers connected in tandem in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, an electrical submersible pump (ESP) 11 typically includes an electrical motor 13. Motor 13 is normally a three-phase AC motor and may be connected in tandem to other motors. An upper seal section or thrust hearing unit 15 is illustrated at an upper end of motor 13. Thrust bearing unit 15 has a thrust bearing to absorb down thrust. ESP 11 may be operated in horizontal as well as vertical orientations, thus the terms "upper" and "lower" are used only for convenience and not in a limiting manner. A pressure equalizing assembly connects to the lower end of motor 13. In this embodiment, the pressure equalizing assembly includes an upper pressure equalizer or seal section 17 is shown connected to a lower end of motor 13. In this example, a lower pressure equalizer 19 optionally connects in tandem to the lower end of upper pressure equalizer 17. Each pressure equalizer 17, 19 has features to equalize the pressure differential between a dielectric motor lubricant in motor 13 and the exterior well fluid hydrostatic pressure. The upper and lower pressure equalizers 17, 19 also provide barrier redundancy by separating the motor lubricant from the well fluid with an intermediate fluid chamber. An instrument module, sensor or gauge unit 21 to measure various motor parameters optionally may be mounted to the lower end of lower pressure equalizer 19.

A pump 23 connects to the upper end of thrust bearing unit 15 in this example. Pump 23 could be a centrifugal pump with a large number of stages, each stage having an impeller and a diffuser. Alternately, pump 23 could be another type, such as a progressing cavity pump. Pump 23 has an intake 25 for admitting well fluid. A string of production tubing 26 secures to the upper end of pump 23 and supports ESP 11 in a well. Production tubing string 26 may be sections of tubing with threaded ends secured together, or it could be continuous coiled tubing.

Figure 2A:
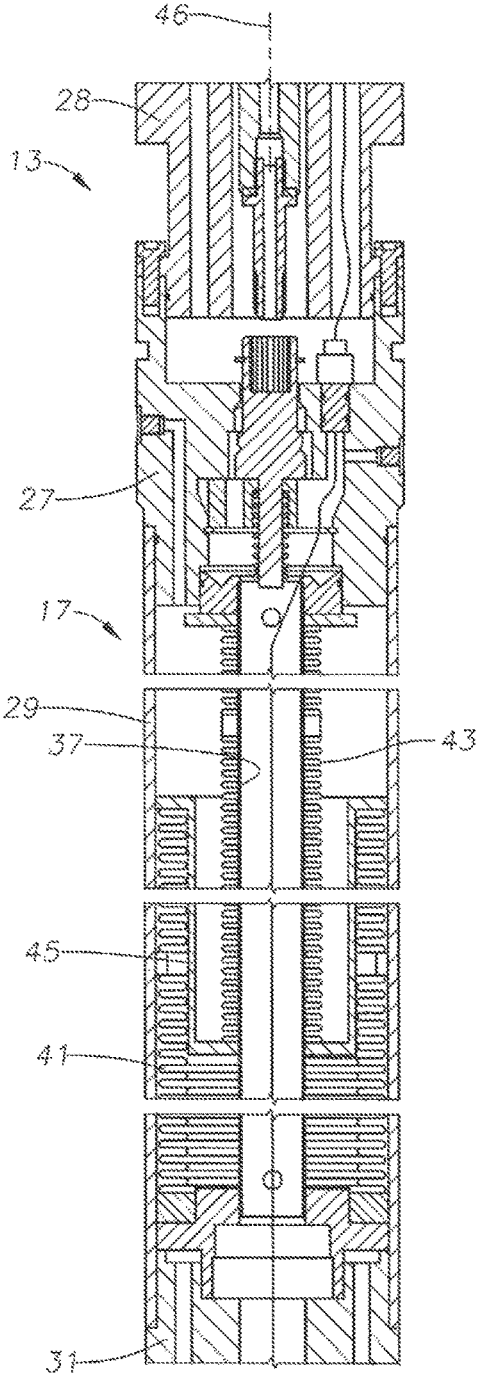
FIGS. 2A and 2B comprise a sectional view of the upper pressure equalizer of the pump assembly of FIG. 1.
Figure 2B:
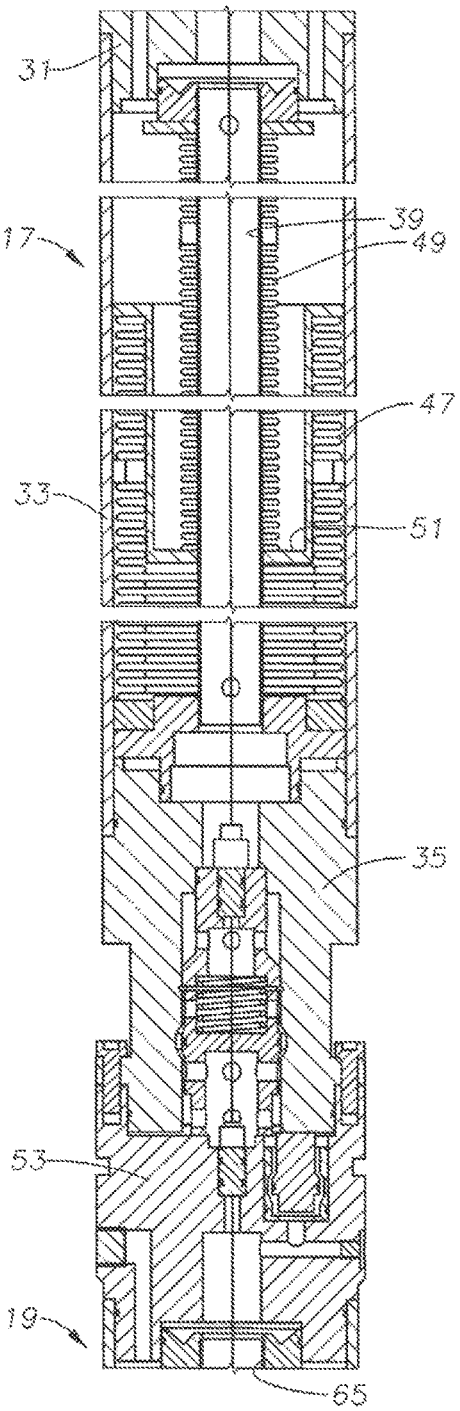
Figure 3A:
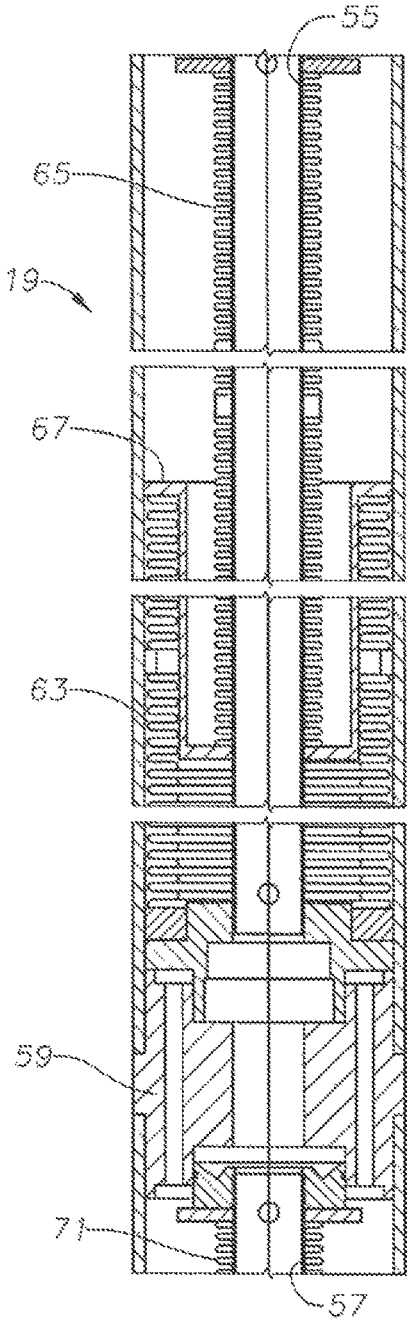
FIGS. 3A and 3B comprise a sectional view of the lower pressure equalizer of the pump assembly of FIG. 1.
Figure 3B:
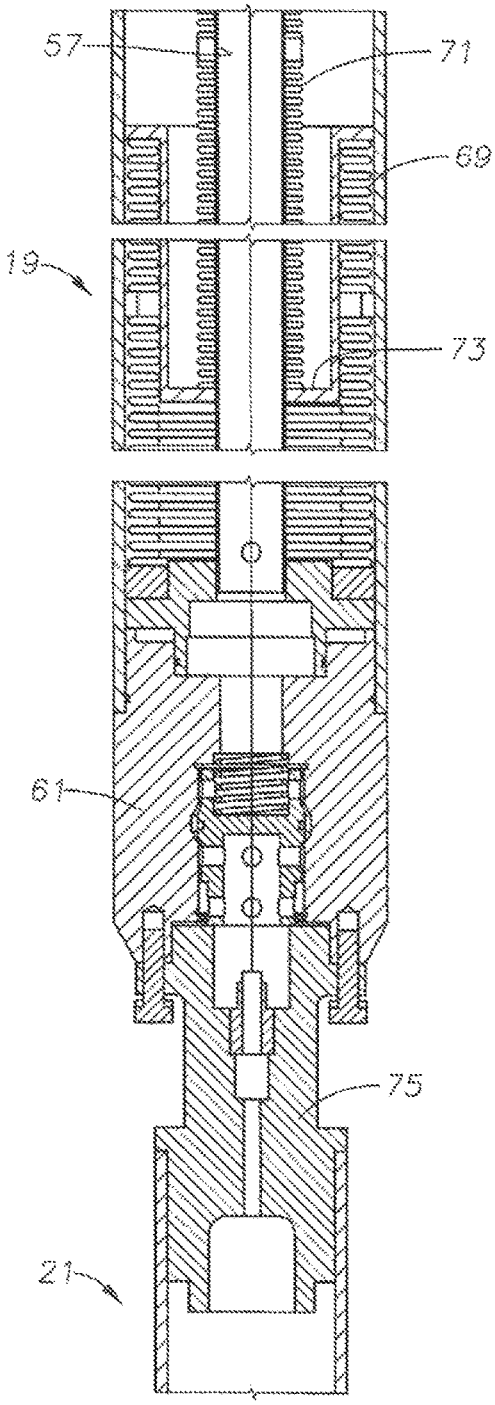

Referring to FIGS. 2A and 2B, upper pressure equalizer 17 has an upper adapter or connector 27 on its upper end that bolts or secures by a rotatable threaded collar to a lower adapter or connector 28 of motor 13. In this example, both upper pressure equalizer 17 and lower pressure equalizer 19 have upper and lower chambers, but a single chamber in each would also work. The upper chamber of upper pressure equalizer 17 comprises an upper housing section 29 secured to upper connector 27. An intermediate connector 31 connects the lower end of upper housing section 29 to a lower housing section 33, shown in FIG. 28. Lower housing section 33 has a lower connector 35 for connecting to lower pressure equalizer 19 (FIGS. 3A and 3B). An upper guide tube 37 extends between upper connector 27 and intermediate connector 31 within upper housing section 29. A lower guide tube 39, which is in fluid communication with upper guide tube 37, extends between intermediate connector 31 and lower connector 35.

A flexible element in this example comprises an upper outer bellows 41 and an upper inner bellows 43, both located within upper housing section 29 surrounding upper guide tube 37. Upper outer bellows 41 has a fixed lower end sealed to intermediate connector 31 and a movable upper end sealed to upper inner bellows 43 by a bellows interconnect 45. Bellows interconnect 45 is a sleeve with a lower internal flange and an upper external flange. Bellows interconnect 45 seals the interiors of bellows 41, 43 from the exteriors. The upper end of upper inner bellows 43 is fixed and sealed to upper connector 27. Bellows interconnect 45 moves along axis 46 as inner and outer bellows 43, 41 extend and contract.

Similarly, a lower outer bellows 47 and a lower inner bellows 49 are located in lower housing section 33. A bellows interconnect 51 joins the lower end of lower inner bellows 49 to the upper end of lower outer bellows 47. The interiors of bellows 41, 43, 47 and 49 are in fluid communication with each other. The exteriors of bellows 41, 43, 47 and 49 are in fluid communication with each other.

Referring to FIGS. 3A and 3B, lower pressure equalizer 19 may be identical to upper pressure equalizer 17, as shown, or it may differ. Lower pressure equalizer 19 has an upper connector 53 that bolts to lower connector 35 of upper pressure equalizer 17. An upper guide tube 55 and a lower guide tube 57 are joined by an intermediate connector 59. Lower guide tube 57 extends to a lower connector 61. In this example, lower pressure equalizer 17 has an upper outer bellows 63 and an upper inner bellows 65 connected by an upper interconnect 67. Lower pressure equalizer 17 has a lower outer bellows 69 and a lower inner bellows 71 connected to each other by a bellows interconnect 73. A gauge unit adapter 75 for gauge unit 21 is illustrated as being connected to lower connector 61.

Guide tubes 55, 57 of lower pressure equalizer 19 are in fluid communication with each other, but not with guide tubes 37, 39 of upper pressure equalizer 17. The interiors of lower equalizer bellows 63, 65, 69 and 71 are in fluid communication with each other and with the exterior of upper pressure equalizer bellows 41, 43, 47 and 49. The exteriors of lower equalizer bellows 63, 65, 69 and 71 are in fluid communication with each other, but not with the exteriors of upper pressure equalizer bellows 41, 43, 47 and 49. Porting in guide tubes 37, 39, 55, 57 and in connectors 35, 53 results in this arrangement.

In this disclosure, upper pressure equalizer 17 and lower pressure equalizer 19 are prefilled at a service center or factory with a motor lubricant to a selected level, then brought to the well site as separate pieces. The selected level may provide room for thermal expansion of the lubricant. The lubricant expands with the temperature increase due to well depth and operation of motor 13. Optionally, one or both pressure equalizers 17, 19 may have check valves to release lubricant in the event of over-expansion. At the well site, pressure equalizers 17, 19 are connected together, to gauge unit 21, and to motor 13. The process of connecting pressure equalizers 17, 19 to each other automatically communicates the motor lubricant or secondary liquid in one with the other.

Figure 4:
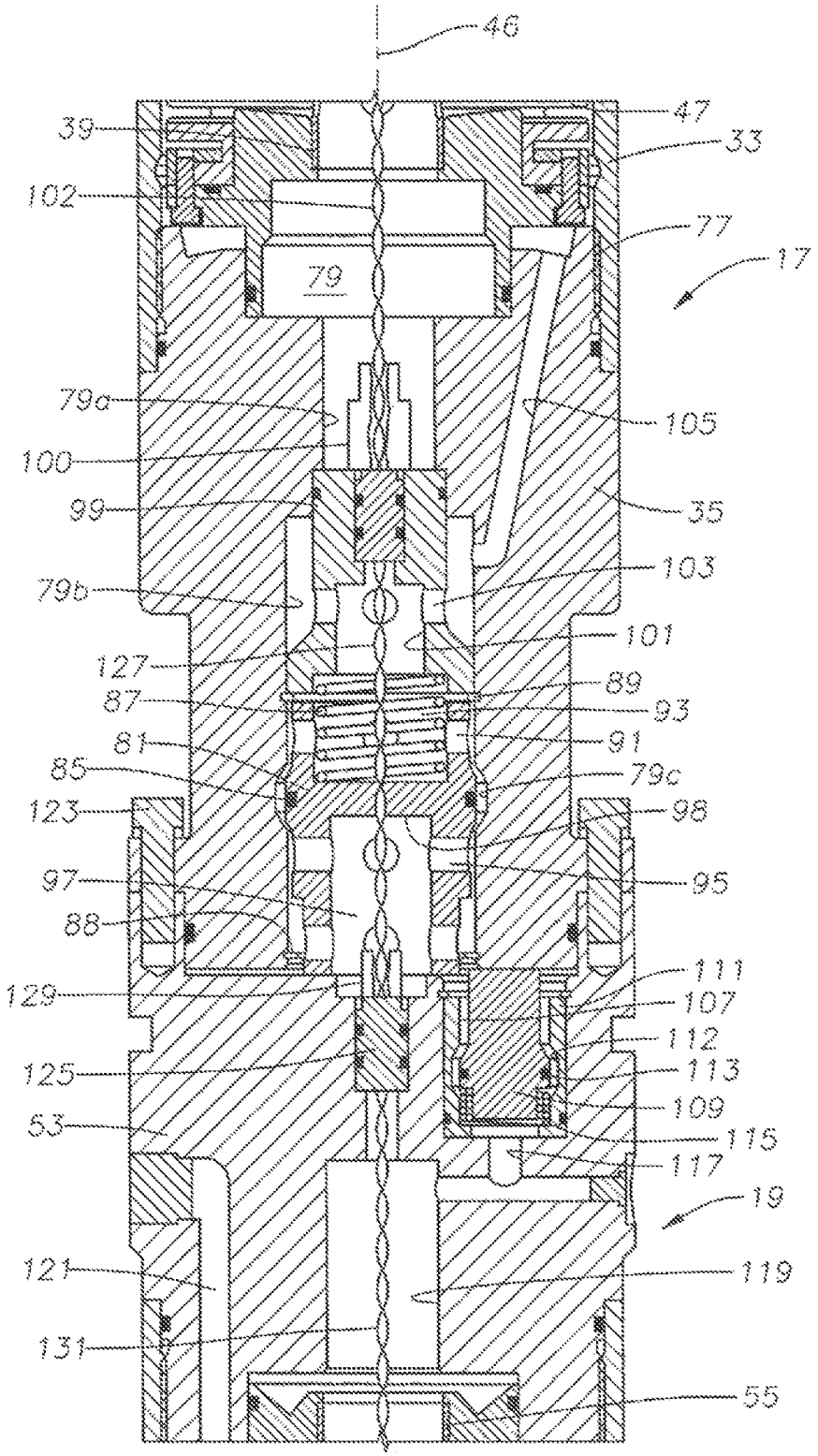
FIG. 4 is an enlarged sectional of the connection between the upper pressure equalizer of FIGS. 2A and 2B, and the lower pressure equalizer of FIGS. 3A and 3B.

Referring to FIG. 4, lower connector 35 of upper pressure equalizer 17 has external threads 77 that secure lower connector 35 to upper pressure equalizer lower housing section 33. Lower connector 35 has an axial bore 79 with a smaller diameter portion 79*a* leading downward to a counterbore 79*b* of larger diameter than smaller diameter portion 79*a*. An annular groove or recess 79*c* is located in counterbore 79*b*. A valve element 81 is carried in counterbore 79*b* for movement along axis 46 between an upper open position, which is shown, and a lower closed position (not shown). Valve element 81 has an annular seal 85 that moves below recess 79*c* and seals to counterbore 79*b* while valve element 81 is in the closed position. While valve element 81 in the open position, valve element seal 85 is located in alignment with recess 79*c*, allowing fluid flow past valve element 81. A coil spring 87 urges valve element 81 downward to the closed position. In the lower, closed position, a downward facing shoulder on valve element 81 abuts a lower retaining ring 88 located in counterbore 79*b*. While in the lower position, the lower end of valve element 81 protrudes past the lower end of lower connector 35. When lower pressure equalizer upper connector 53 connects to upper pressure equalizer connector 35, it abuts valve element 81 and pushes it upward to the open position shown. An upper retaining ring 89 in counterbore 79*b* is located slightly above valve element 81 while in the upper position.

Valve element 81 may have a variety of configurations. In this example, valve element 81 has upper ports 91 extending outward from an upper cavity 93, which contains spring 87. Upper ports 91 are located above seal 85, which is located on an enlarged diameter portion of valve element 81. Valve element 81 has lower ports 95 located below seal 85 and extending outward from a lower cavity 97, which is separated from upper cavity 93 by a barrier 98. While in the open position, fluid can flow from lower cavity 97 around seal 85 to upper cavity 93 via ports 91, 95. The outer diameter of valve element 81 at ports 91 and at ports 95 is less than the inner diameter of counterbore 79*b*, creating an annular passage to allow fluid flow while valve element 81 is in the open position.

In this embodiment, an electrical receptacle 99 has an upper end fixed and sealed in smaller diameter bore portion 79*a*. The lower end of electrical receptacle 99 extends down to and is supported by upper retaining ring 89. An electrical connector or plug 100 connects into an upper end of electrical receptacle 99. Electrical connector 100 is located on a lower end of a line or electrical wire 102 extending downward through guide tubes 37, 39 of upper pressure equalizer 17. Electrical receptacle 99 has a lower cavity 101 that registers with valve element upper cavity 93. Ports 103 extend outward through a side wall of electrical connector 100 to communicate fluid to and from a passage 105 leading to an upper end portion of intermediate connector 35.

Referring still to FIG. 4, upper connector 53 of lower pressure equalizer 19 has a valve cavity 107 in its upper end offset horn axis 46. A valve element 109 is carried in valve cavity 107 for axial movement between a lower open position, which is shown, and an upper closed position (not shown). Valve cavity 107 optionally may have an interior fixed sleeve 111 that defines a seat and annular recess 112 for valve element 109. A seal 113 on valve element 109 seals to the inner wall of valve cavity 107 while in the closed position. Seal 113 aligns with recess 112 to bypass fluid while in the open position. A coil spring 115 urges valve element 109 upward toward the closed position. While in the closed position, the lower end of valve element 109 protrudes above a central upper end portion of connector 53. When connectors 53, 35 are joined, connector 35 pushes valve element 109 downward to the open position.

A passage 117 communicates valve cavity 107 with an axial bore 119 formed in connector 53. Connector 53 also has a well 11 aid entry passage 121 that leads to the exterior of upper outer bellows 69 and upper inner bellows 71 (FIGS. 3A and 3B) of lower pressure equalizer 19. Bolts 123 are used to connect connectors 53 and 35, but threaded collars could alternately be employed.

An electrical receptacle 125 is fixed and sealed within an upper, smaller diameter portion of bore 119. A line or wire 127 extends downward from electrical receptacle 99 of connector 35 and has a plug or connector 129 on its lower end. Line 127 extends sealingly through a passage in part of valve element 81. The portion of line 127 sealed within valve element 81 moves axially in unison with valve element 81. When making connectors 53 and 35 up with each other, a worker will releasably plug electrical connector 129 into receptacle 125. A wire 131 is joined to electrical receptacle 125 and extends downward in bore 119 through guide tubes 55, 57 of lower pressure equalizer 19.

Figure 5:
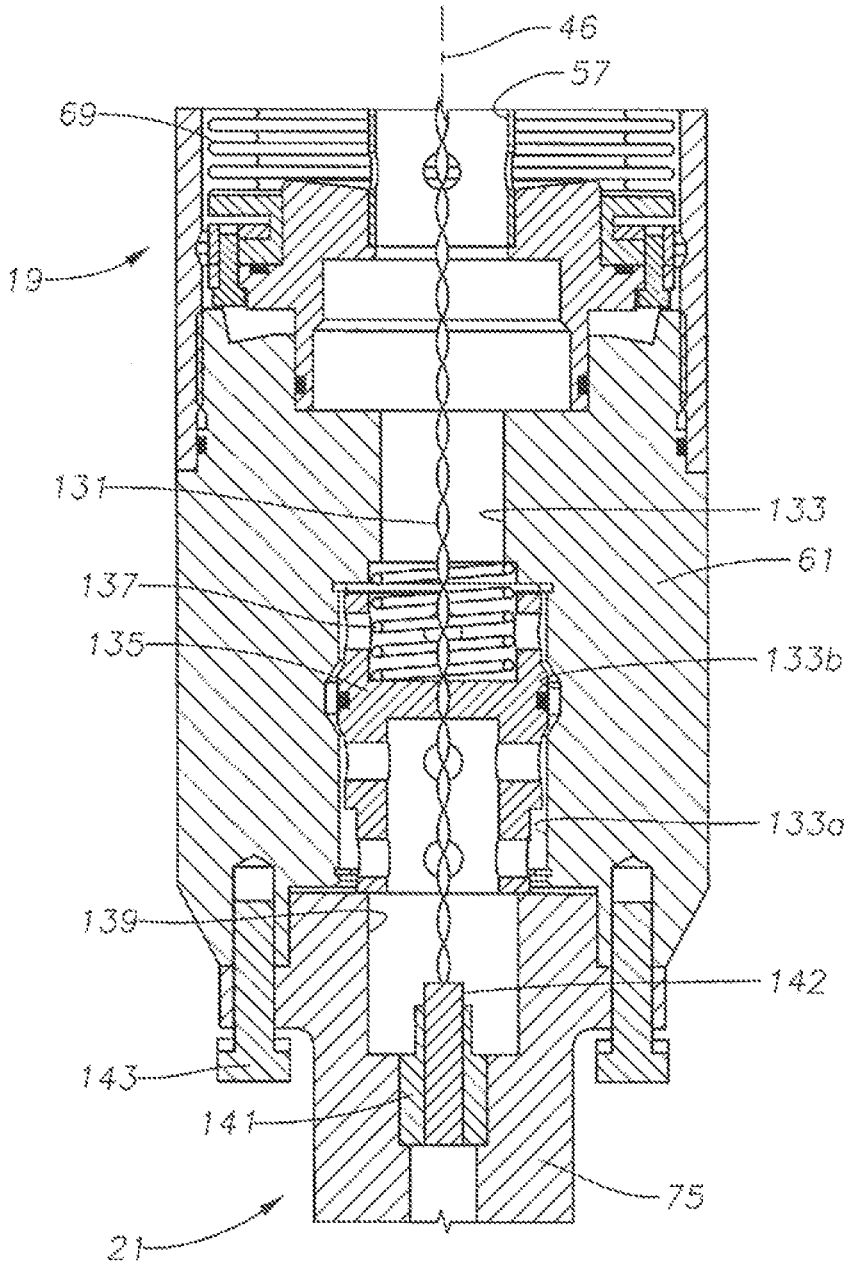
FIG. 5 is an enlarged sectional view of the connection between the lower pressure equalizer of FIGS. 3A and 3B and a gauge unit.

Referring to FIG. 5, lower connector 61 of lower pressure equalizer 19 has a bore 133 with an enlarged counterbore 133*a* having an annular recess 133*b*. A valve element 135 moves within counterbore 133*a* between an upper open position, which is shown, and a closed lower position (not shown). Valve element 135 may have the same configuration as valve element 81 (FIG. 4), as shown. A spring 137 urges valve element 135 downward to the closed position. Gauge unit adapter 75 has an upper end that abuts valve element 135, pushing it to the open position, when gauge unit 21 is connected to lower pressure equalizer 19. Gauge unit wire 131 extends through and is sealed within a passage in valve element 135. The portion of wire 131 within valve element 135 moves axially in unison with valve element 135 while valve element 135 moves between closed and open positions.

Adapter 75 has a central upward facing cavity 139 that is in fluid communication with counterbore 133*a* when adapter 75 is connected to lower connector 61. An electrical receptacle 141 is located in cavity 139 on axis 46. Wire 131 has an electrical plug or connector 142 on its lower end that is inserted by a worker into receptacle 141 just before securing adapter 75 to connector 61. The portion of wire 131 below valve element 135 has enough slack to enable insertion of connector 142 into receptacle 141 before gauge unit adapter 75 is secured to lower connector 61. Bolts 143 or a threaded ring (not shown) may be used to secure adapter 75 to connector 61.

Figure 6:
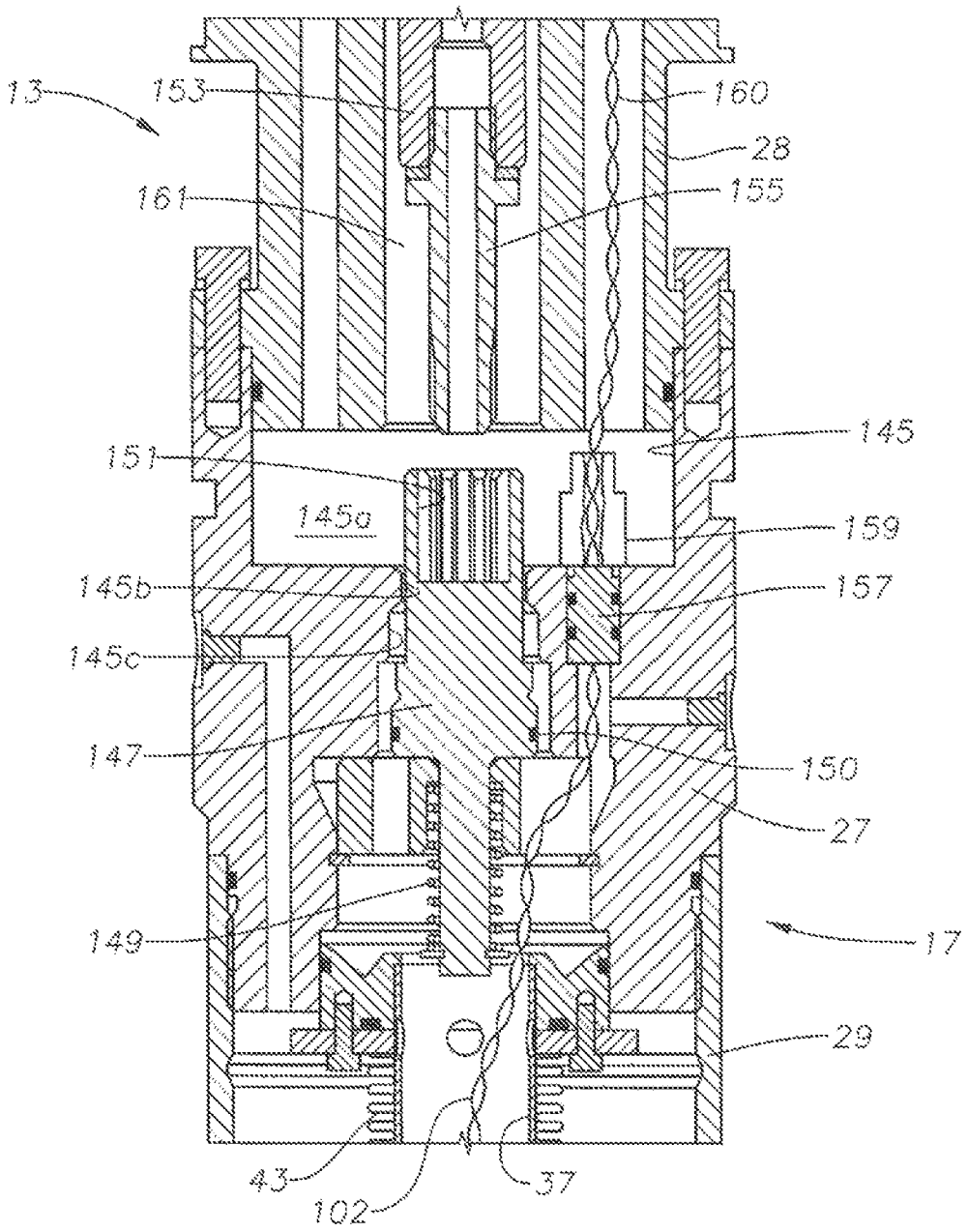
FIG. 6 is an enlarged sectional view of the upper connector of the upper pressure equalizer of FIGS. 2A and 2B.

FIG. 6 shows one example of an arrangement for connecting upper connector 27 of upper pressure equalizer 17 to lower connector 28 of motor 13. Upper connector 27 has a bore 145 with a counterbore 145*a*, a reduced diameter threaded section 145*b*, and a seal area 145*c*. Seal area 145*c* is located below threaded section 145*b* and has a larger inner diameter than threaded section 145*b*. A valve element 147 has an upper portion extending above threaded section 145*b* and a lower portion extending below seal area 145*c*. Valve element 147 moves axially between a lower open position, which is shown, and an upper closed position (not shown). A spring 149 urges valve element 147 downward toward the open position. Seal 150 on valve element 147 seals to seal area 145*c* while valve element 147 is in the closed upper position. Valve element 147 has an upward facing splined receptacle 151 on its upper end.

Motor 13 has a rotatably driven drive shaft 153 that extends into motor lower connector 28. There is no rotating shaft within pressure equalizers 17, 19. A tool 155 secured to the lower end of drive shaft 153 by threads has splines that will slide into mating engagement with splined receptacle 151 while valve element 147 is in the upper closed position. Rotating motor shaft 153 an increment after pressure equalizer connector 27 is connected to motor lower connector 28 will cause valve element 147 to unscrew from threaded section 145*b* and spring downward to the open position.

In this example, an electrical receptacle 157 is mounted offset from axis 46 to an upward facing portion of counterbore 145*a*. An electrical plug or connector 159 extending downward on a wire 160 from the Interior of motor 13 connects to electrical receptacle 157. Wire 160 leads to sensors for monitoring parameters in the motor lubricant, such as pressure and temperature. Wire 160 may also lead to an upper external connection (not shown) on motor 13, which connects to a motor lead or power cable extending from a wellhead at the surface. Signals may be transmitted from gauge unit 21 and power supplied via a separate wire or one bundled into the power cable. Alternatively, wire 160 extending to electrical connector 159 could be tied into a null point of the windings of motor 13 to superimpose signals from gauge unit 21 on the power cable. Prior to securing upper pressure equalizer 17 to motor 13, a worker will plug releasably electrical connector 159 into electrical receptacle 157. Motor 13 has passages 161 that communicate motor lubricant from motor 13 to bore 145.

During assembly, pressure equalizers 17, 19 will be prefilled with a liquid, preferably motor lubricant, to a desired level at a service center or factory and brought to the well site disconnected from each other. Referring to FIG. 4, lower connector 35 of upper pressure equalizer 17 will prevent any leafage of lubricant due to valve element 81 being in a lower closed position (not shown). Seal 85 will engage counterbore 79*b* below recess 79*c*. Referring also to FIG. 6, upper connector 27 of upper pressure equalizer 17 will prevent any leakage of lubricant due to valve element 147 being in the upper closed position (not shown). Similarly, upper connector 53 of lower pressure equalizer 19 will prevent any leakage of lubricant due to valve element 109 being in the upper closed position (not shown). Lower connecter 61 of lower pressure equalizer 19 will prevent any leakage of lubricant due to valve element 135 (FIG. 5) being in the lower closed position (not shown).

When ready to connect upper pressure equalizer 17 to lower pressure equalizer 19, the operator will first insert electrical connector 129 into electrical receptacle 127. As bolts 123 are secured, connector 53 will push valve element 81 to the open position, and connector 35 will push valve element 109 to the open position, communicating motor lubricant between pressure equalizers 17 and 19.

The operator connects gauge unit 21 either before or after connecting pressure equalizers 17, 19 in a similar manner by first inserting electrical connector 142 into engagement with electrical receptacle 141, as shown in FIG. 6. As the operator secures bolts 143, adapter cavity 139 will be placed in communication with the motor lubricant in lower pressure equalizer 19.

Referring to FIG. 6, prior to securing upper pressure equalizer 17 to motor 13, the operator will insert electrical connector 159 on the end of the instrument wire (not shown) in motor 13 into engagement with electrical receptacle 159. The operator bolts upper pressure equalizer 17 to motor 13, and valve element 147 will initially remain in the upper closed position (not shown). The operator lowers the assembly into the well bore for a distance that places the upper end of motor 13 or thrust bearing unit 15 accessible to the workers. Motor 13 may be filled with motor lubricant at this time or earlier. The closed valve element 147 will isolate pressure equalizers 17, 19 from the weight of the column of lubricant in motor 13. When ready to place upper pressure equalizer 17 in communication with the motor lubricant in motor 13, a worker will employ a hand tool at the upper end of motor 13 or thrust bearing unit 15 to rotate motor shaft 153 an increment, which loosens valve element 147. Spring 149 and gravity cause valve element 147 to move downward to the open position shown, communicating the motor lubricant in motor 13 with the motor lubricant in upper pressure equalizer 17.

The operator attaches pump 23 and lowers ESP 11 on production tubing 26 into the well. Well fluid will act on pressure equalizers 17, 19, reducing a pressure differential between the hydrostatic pressure of the well fluid and the motor lubricant.

Various possibilities exist for equalizing the hydrostatic well fluid pressure with the motor lubricant pressure. In the embodiment shown, the porting within connectors 35, 53 as well as other places causes dielectric oil or motor lubricant in motor 13 to be in direct communication with motor lubricant located in guide tubes 37, 39 of the upper pressure equalizer 17. Ports in guide tubes 37, 39 cause this dielectric lubricant to be located within the interiors of bellows 41, 43 and 47, 49 of upper pressure equalizer 17. A secondary dielectric fluid, which may be the same lubricant as the lubricant in motor 13 or a different liquid, will be located on the exteriors of bellows 41, 43, 47 and 49 of upper equalizer 17; the secondary dielectric fluid is thus isolated from direct communication with the dielectric lubricant in motor 13. The secondary dielectric fluid will also be located in guide tubes 55, 57 and the interiors of bellows 63, 65, 69, and 71 of lower equalizer 19. The secondary dielectric fluid in lower equalizer 19 will be in direct communication with the secondary dielectric fluid in upper equalizer 17. Porting in lower equalizer, such as in lower connector 61 and/or lower intermediate connector 59 admits well fluid to the exteriors of bellows 63, 65, 69 and 71 of lower equalizer 19. The well fluid is thus isolated from the fluid within motor 13 by the secondary dielectric fluid in the interiors of lower equalizer bellows 63, 65, 69 and 71 and on the exteriors of upper equalizer bellows 41, 43 and 47, 49.

While the disclosure has been shown in only one of its forms, it should be apparent to those skilled in the art that various changes may be made.

The invention claimed is:

1. An electrical submersible pump assembly, comprising:

a pump;

a motor having a rotatable shaft extending along a longitudinal axis and operatively coupled to the pump for driving the pump;

an upper pressure equalizer coupled to a lower end of the motor;

a lower pressure equalizer, each of the pressure equalizers having a movable equalizing element that communicates well fluid pressure exterior of the pressure equalizers to motor lubricant in the motor;

a connection between an upper end of the lower pressure equalizer and a lower end of the upper equalizer;

a liquid flow passage in the connection through which a liquid in the upper pressure equalizer communicates with a liquid in the lower pressure equalizer;

at least one connection valve located in the liquid flow passage that closes the liquid flow passage prior to connecting the pressure equalizers with each other, and opens the liquid flow passage after the connection between the lower pressure equalizer and the upper pressure equalizer is made;

wherein the connection comprises:

an upper pressure equalizer lower adapter secured to a lower end of the upper pressure equalizer;

a lower pressure equalizer upper adapter secured to an upper end of the lower pressure equalizer; wherein:

the liquid flow passage extends through the upper pressure equalizer lower adapter and through the lower pressure equalizer upper adapter;

the at least one valve comprises an upper pressure equalizer lower valve and a lower pressure equalizer upper valve;

the upper pressure equalizer lower valve being axially movable within the liquid flow passage in the upper pressure equalizer lower adapter and spring biased downward from an open position to a closed position, the upper pressure equalizer valve having an upper portion with an outer diameter that seals to the liquid flow passage while in the closed position, the upper pressure equalizer valve having a lower portion that has a smaller outer diameter than the upper portion and is surrounded by an annular clearance in the liquid flow passage in the upper pressure equalizer lower adapter both while in the closed position and while in the open position, the lower portion having a lower end that protrudes below a lower end of the upper pressure equalizer lower adapter while in the closed position; and the lower pressure equalizer upper valve being axially movable within the liquid flow passage in the lower pressure equalizer upper adapter and spring biased upward from an open position to a closed position, the lower pressure equalizer valve having a lower portion with an outer diameter that seals to the liquid flow passage in the lower pressure equalizer upper adapter while in the closed position, the lower pressure equalizer valve having an upper portion that has a smaller outer diameter than the lower portion of the lower pressure equalizer valve and is surrounded by an annular clearance in the liquid flow passage in the lower pressure equalizer upper adapter both while in the closed position and while in the open position, the upper portion of the lower valve having an upper end that protrudes above the lower pressure equalizer upper adapter while in the closed position.

2. An electrical submersible pump assembly, comprising:

a pump;

a motor having a rotatable shaft extending along a longitudinal axis and operatively coupled to the pump for driving the pump;

an upper pressure equalizer coupled to a lower end of the motor;

a lower pressure equalizer, each of the pressure equalizers having a movable equalizing element that communicates well fluid pressure exterior of the pressure equalizers to motor lubricant in the motor;

a connection between an upper end of the lower pressure equalizer and a lower end of the upper equalizer;

a liquid flow passage in the connection through which a liquid in the upper pressure equalizer communicates with a liquid in the lower pressure equalizer;

at least one connection valve located in the liquid flow passage that closes the liquid flow passage prior to connecting the pressure equalizers with each other, and opens the liquid flow passage after the connection between the lower pressure equalizer and the upper pressure equalizer is made; wherein the connection comprises:

an upper pressure equalizer lower adapter secured to the lower end of the upper pressure equalizer;

a lower pressure equalizer upper adapter secured to the upper end of the lower pressure equalizer; wherein the liquid flow passage extends through the upper pressure equalizer lower adapter and through the lower pressure equalizer upper adapter;

the at least one connection valve comprises an upper pressure equalizer lower valve and a lower pressure equalizer upper valve;

the upper pressure equalizer lower valve is mounted in the liquid flow passage in the upper pressure equalizer lower adapter and spring biased downward to a closed position protruding from a lower end of the upper pressure equalizer lower adapter;

the lower pressure equalizer upper valve is mounted in the liquid flow passage in the lower pressure equalizer upper adapter and spring biased upward to a closed position protruding from an upper of the lower pressure equalizer upper adapter; and wherein the upper pressure equalizer lower valve and the lower pressure equalizer upper valve are radially offset from each other relative to the axis such that they do not contact each other when the lower pressure equalizer upper adapter is secured to the upper pressure equalizer lower adapter.

3. The assembly according to claim 2, wherein:

the movable equalizing element within each of the upper and lower pressure equalizers comprises a bellows;

motor lubricant in fluid communication with the motor lubricant in the motor is located within an interior of the bellows of the upper pressure equalizer;

a secondary liquid is located on an exterior of the bellows of the upper pressure equalizer and an interior of the bellows of the lower pressure equalizer, the secondary liquid on the exterior of the bellows of the upper pressure equalizer being in fluid communication with the secondary liquid in the interior of the bellows of the lower pressure equalizer; and the bellows of the lower pressure equalizer is adapted to be immersed in well fluid.

4. The assembly according to claim 2, further comprising:

a motor equalizer adapter between an upper end of the upper pressure equalizer and a lower end of the motor;

a motor equalizer passage in the motor equalizer adapter for the passage of motor lubricant between the motor and the upper pressure equalizer;

a motor equalizer valve in the motor equalizer passage that is movable between an open position and a closed position; and wherein an end portion of the shaft is in engagement with the motor equalizer valve while the motor equalizer valve is in a closed position; and the motor equalizer valve is movable from the closed position to an open position in response to rotation of the shaft.

5. The assembly according to claim 2, further comprising:

a sensor unit mounted to a lower end of the lower pressure equalizer;

a sensor lower equalizer line extending from the sensor unit through the lower pressure equalizer to a lower terminal at the upper end of the lower pressure equalizer;

a sensor upper equalizer line releasably connected to the lower terminal and extending through the upper pressure equalizer to an upper terminal at an upper end of the upper pressure equalizer; and a sensor motor line extending downward from the motor and in releasable engagement with the upper terminal.

6. The assembly according to claim 2, further comprising:

a sensor unit mounted to a lower end of the lower pressure equalizer;

a sensor lower equalizer wire extending from the sensor unit through the lower pressure equalizer to a lower electrical terminal at the upper end of the lower pressure equalizer;

a sensor upper equalizer wire releasably connected to the lower electrical terminal and extending through the upper pressure equalizer to an upper electrical terminal at the upper end of the upper pressure equalizer;

a sensor motor wire extending downward from the motor and in engagement with the upper electrical terminal; wherein:

the liquid flow passage includes a first portion located on the axis and a second portion radially offset from the axis;

the at least one connection valve comprises a first valve mounted on the axis and a second valve radially offset from the first valve; and a portion of the sensor motor wire extends sealingly through the first valve.

7. An electrical submersible pump assembly, comprising:

a pump;

a motor having a rotatable shaft extending along a longitudinal axis and operatively coupled to the pump for driving the pump;

a pressure equalizer assembly coupled to a lower end of the motor, the pressure equalizer assembly having a movable element for communicating well fluid pressure exterior of the pressure equalizer assembly to motor lubricant in the motor;

an upper adapter that connects the pressure equalizer assembly to the motor, the upper adapter having an upper lubricant passage through which motor lubricant in the motor communicates with motor lubricant in pressure equalizer assembly;

an upper valve located in the upper lubricant passage that selectively opens and closes the upper lubricant passage;

a sensor unit mounted to a lower end of the pressure equalizer assembly for sensing well fluid parameters;

a pressure equalizer sensor wire extending from the sensor unit through the pressure equalizer assembly to an electrical upper terminal on the upper adapter, the upper terminal being radially offset from the axis and from the upper valve;

a motor sensor wire extending downward from an interior of the motor and releasably engaging the upper terminal;

a lower adapter secured to the lower end of the pressure equalizer assembly, the lower adapter having a lower liquid flow passage in fluid communication with a cavity in the sensor unit;

an electrical lower terminal mounted in the cavity;

an equalizer lower valve mounted on the axis in the lower liquid passage, the equalizer lower valve protruding downward from the lower adapter while in a lower closed position and being axially movable from the lower closed position to an upper open position in response to abutting contact with the sensor unit when the sensor unit is being connected to the pressure equalizer assembly;

a spring that urges the equalizer lower valve toward the lower closed position; wherein a lower end of the equalizer sensor wire extends sealingly through the equalizer lower valve and releasably engages the lower terminal; and a portion of the equalizer sensor wire located within the equalizer lower valve is fixed to the lower valve and moves in unison with the lower valve as the lower valve moves from the lower closed to the upper open position.

8. The submersible pump assembly according to claim 7, wherein:

the movable element comprises a bellows mounted around a guide tube located on the axis; and the pressure equalizer sensor wire extends through the guide tube.

9. The submersible pump assembly according to claim 7, wherein:

the pressure equalizer assembly comprises:

an upper pressure equalizer coupled to a lower end of the motor and a lower pressure equalizer coupled to a lower end of the upper pressure equalizer;

a connection between an upper end of the lower pressure equalizer and the lower end of the upper pressure equalizer;

a liquid flow passage in the connection through which a liquid in the upper pressure equalizer communicates with a liquid in the lower pressure equalizer;

an equalizer intermediate valve located in the liquid flow passage that closes the liquid flow passage prior to connecting the lower and upper pressure equalizers with each other, and opens the liquid flow passage after the connection between the lower pressure equalizer and the upper pressure equalizer is made; and wherein the equalizer sensor wire extends sealingly through the equalizer intermediate valve.

10. The submersible pump assembly according to claim 7, wherein:

the pressure equalizer assembly further comprises:

an upper pressure equalizer coupled to a lower end of the motor and a lower pressure equalizer coupled to the upper pressure equalizer;

a connection between an upper end of the lower pressure equalizer and a lower end of the upper equalizer;

a liquid flow passage in the connection through which a liquid in the upper pressure equalizer communicates with a liquid in the lower pressure equalizer;

an equalizer first intermediate valve located on the axis in the liquid flow passage and being axially movable between an open and a closed position in response to connecting the upper and lower pressure equalizers with each other;

an equalizer second intermediate valve located in the liquid flow passage radially offset from the first intermediate valve and being axially movable between an open and a closed position in response to connecting the upper and lower pressure equalizers with each other; and wherein the equalizer sensor wire extends sealingly through the equalizer first intermediate valve.

* * * * *